United States Patent [19]

Trocino

[11] Patent Number: 4,630,540

[45] Date of Patent: Dec. 23, 1986

[54] DETONATOR APPARATUS FOR LIQUID EXPLOSIVE COMPOSITIONS

[76] Inventor: Joseph L. Trocino, 15233 Ventura Blvd., P-8, Sherman Oaks, Calif. 91403

[21] Appl. No.: 781,348

[22] Filed: Sep. 30, 1985

[51] Int. Cl.[4] ..... F42B 1/02

[52] U.S. Cl. ..... 102/307; 102/318; 102/322; 102/327; 102/331; 102/332; 86/50

[58] Field of Search ..... 102/303, 304, 331, 307, 102/318, 327, 332, 322; 86/1 B

[56] References Cited

U.S. PATENT DOCUMENTS

| | | | |
|---|---|---|---|
| 3,228,331 | 1/1966 | Drimmer | 86/1 B |
| 3,721,201 | 3/1973 | Boller | 86/1 B X |
| 4,013,190 | 3/1977 | Wiggins et al. | 86/1 B X |
| 4,432,285 | 2/1984 | Boyars et al. | 86/1 B X |
| 4,543,872 | 10/1985 | Graham et al. | 86/1 B |

FOREIGN PATENT DOCUMENTS

| | | | |
|---|---|---|---|
| 1229670 | 10/1958 | France | 86/1 B |
| 423598 | 7/1947 | Italy | 86/1 B |
| 520969 | 5/1940 | United Kingdom | 86/1 B |

*Primary Examiner*—Peter A. Nelson

*Attorney, Agent, or Firm*—Roger A. Marrs

[57] ABSTRACT

Detonation apparatus constituting a novel detonation amplifier is disclosed herein having a container enclosing a quantity of combined liquid compositions into which a detonation chamber is submerged. A pyrotechnic charge is suspended with the chamber which is surrounded by the liquid explosive composition. Apertures are provided in the wall of the chamber for permitting the liquid composition to enter the chamber. Activation of the pyrotechnic charge detonates the liquid composition within the chamber which, in turn, detonates the bulk quantity of the liquid composition in the container. In another form, the detonation amplifier includes a shaped charge producing a shock wave reflected back from a baffle to detonate the bulk quantity of the liquid composition in the container.

12 Claims, 5 Drawing Figures

FIG. 1
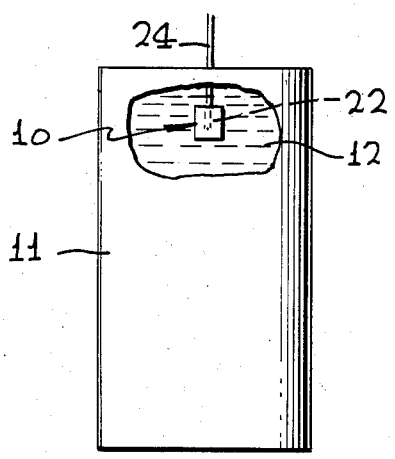
FIG. 2
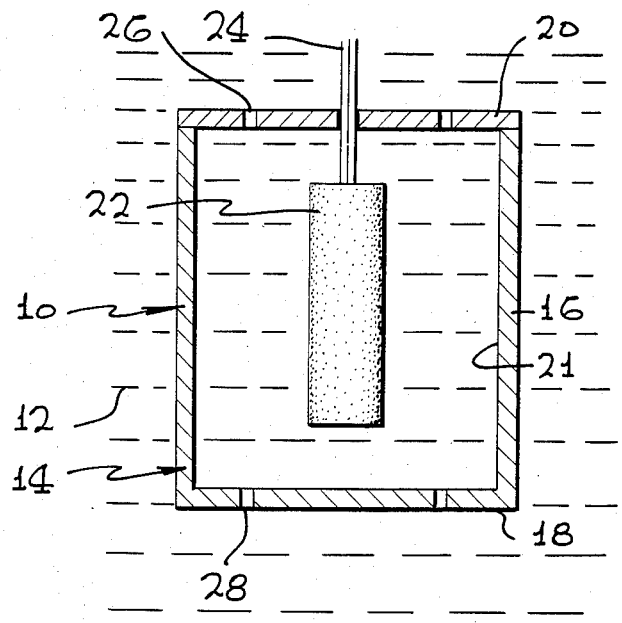
FIG. 3
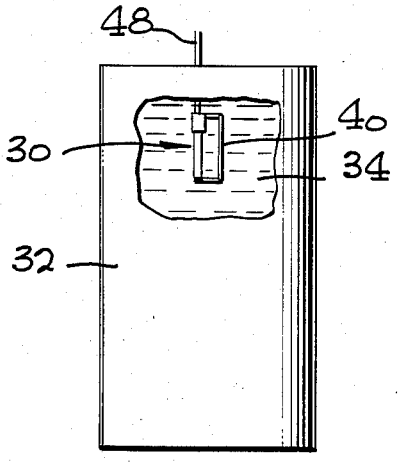
FIG. 4
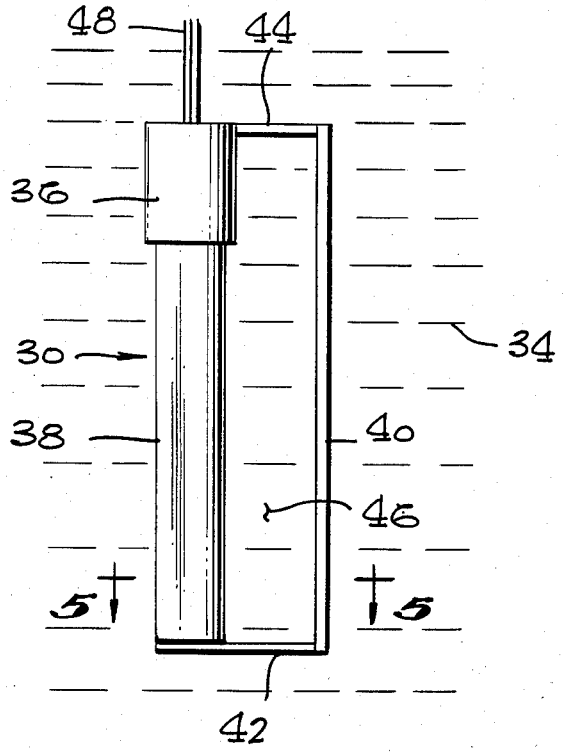
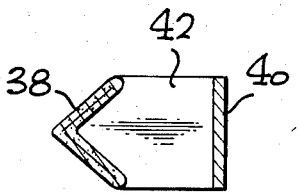
FIG. 5

DETONATOR APPARATUS FOR LIQUID EXPLOSIVE COMPOSITIONS

BACKGROUND OF THE INVENTION

1. Field of the Invention

The present invention relates to a method and apparatus of initiating detonation of liquid explosive compositions and, more particularly, to a novel such detonator constituting a detonationa amplifier used to trigger or activate a larger quantity of bulk liquid explosive.

2. Brief Description of the Prior Art

In the past, it has been the conventional practice to employ solid explosives for a variety of applications. The solid explosive is detonated by the use of a pyrotechnic device such as an initiator cap which is activated by percussion or electrical means. However, such a simplified detonation cannot be readily achieved when using certain classes of liquid explosives which, by their very nature, are less sensitive to initiation with conventional caps. Current art for detonating such liquid explosives involves adding sensitizing agents to increase the mixtures shock sensitivity to an extent which permits them to be detonated with conventional caps. An alternative method within the current art requires the use of a high explosive booster charge. Both of these techniques increase the saftey hazards for persons using the system as well as to property and equipment. Explosives, which can be handles in liquid form, are well known and do find valuable applications in the fields of mining and quarrying as well as in oil production and the like. A considerable effort has been directed to producing powerful liquid explosives and systems employing liquid explosives. However, liquid explosives have the characteristic disadvantage of being very sensitive to spurious shocks which detonate the explosive composition. Transportation and use of these shock sensitive explosives require extreme caution.

Attempts have been made to effectively transport such liquid or semi-liquid explosive compositions by adding a third composition such as a gel so that the resultant compound is comparatively insensitive to detonation by spurious shocks. The addition of the gel greatly reduces the usefulness of the explosive composition inasmuch as a relatively solid or semi-solid explosive compound results which limits the application or usage thereof. For example, liquid compositions are desirable for use in rocks and crevices so that available openings are totally occupied by the liquid explosive composition. Semi-solid or solid explosives cannot be effectively used in such applications.

When utilizing separate liquid ingredients, the separate ingredients constituting the explosive composition may be shipped and stored in separate containers for safety and subsequently combined in proper proportion at the operating site where the explosive composition is to be used. However, detonation of the composition is relatively unstable and, therefore, convnetional liquid compositions are normally discouraged from being used. Experience with such liquid compositions has indicated one or more of the following characteristic disadvantages. Combining and/or mixing the ingredients is a hazardous operation, especially under field conditions. Also, one or more of the ingredients is highly toxic and is hazardous to personnel who handle or mix the liquid ingredients. The composition, once mixed, is shock sensitive and, therefore, hazardous and difficult to dispose of without either detonating the composition immedicately or contaminating the environment. Furthermore, the composition has a short useful life and must be detonated quickly or disposed of which presents additional problems. The composition based on such ingredients requires a large explosive charge as a booster to reliably initiate detonation. Such a booster entails additional procedures, expense and handling.

Therefore, there has been a long standing need to provide a liquid explosive composition which may be readily handled at the operational site and detonated without hazard to personnel handling or mixing the ingredients of explosive systems or initiating the detonation. In particular, by employing ingredients which are normally considered insenstive to shock and by separately transporting and storing the ingredients in separate containers, mixture can be taken at the site of use without hazard. The characteristic disadvantages of liquid compositions may be achieved by avoiding the need for high sensitive liquid mixtures and/or powerful booster charges through the use of a novel detonation amplifier as will be described hereinafter.

SUMMARY OF THE INVENTION

Accordingly, the above problems and difficulties are obviated by the present invention which provides a novel method and apparatus for detonating liquid explosive compositions which include employing a container for holding a bulk quantity of liquid composition composed of ingredients normally insensitive to spurious shock detonation. A detonating amplifying means is immersed into a portion of the bulk liquid composition which includes a pyrotechnic charge adapted to be remotely ignited or activated so as to detonate a limited portion of the bulk explosive which subsequently detonates the entire bulk quantity. In one form of the invention, the detonator amplifier takes the form of an apertured chamber housing the pyrotechnic charge which is submerged into the liquid explosive composition so that a portion of the liquid enters the chamber and surrounds the charge. In another form of the invention, a shaped charge is carried in fixed spaced apart relationship with respect to a baffle whereby a reflected shock wave initiates explosion of a small portion of the bulk which results in subsequent detonation of the entire bulk quantity of liquid explosive composition.

Therefore, it is among the primary objects of the present invention to provide a novel method and apparatus of detonating large quantities of liquid explosive composition utilizing a detonator amplifier means without the use of a large booster charge and which can be employed to initiate detonation in bulk quantities of certain chemicals, such a nitromethane, which is normally so insensitive to shock as to not normally be classed as an explosive.

Still another object of the present invention is to provide a novel method and apparatus for detonating liquid explosive compositions which employs a detonation amplifier submerged within a bulk density of the liquid explosive composition whereby a portion of the bulk composition is triggered or activated in such a manner as to subsequently detonate the remaining bulk composition.

Yet another object of the present invention is to provide a novel apparatus and method for detonating explosive compositions comprised of liquid ingredients which is non-toxic and is not hazardous to handle or mix at the site of operation with respect to personnel or equipment.

Another object of the present invention is to provide a novel method and apparatus for detonating liquid explosive composition which does not require a large explosive charge as a booster so as to reliably initiate the detonation and which employs liquid ingredients that may be readily combined or mixed at the site under field conditions without undue hazard or danger to handling personnel.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a side elevational view of a container holding a bulk quantity of liquid explosive composition and having a portion of the container broken away illustrating the novel detonation amplifier of the present invention submerged in the bulk composition;

FIG. 2 is an enlarged cross-sectional view of the detonation amplifier shown in FIG. 1;

FIG. 3 is a side elevational view of a container holding a quantity of liquid explosive composition and incorporating a detonation amplifier of a different embodiment;

FIG. 4 is an enlarged side elevational view of the different detonation amplifier as shown in the apparatus of FIG. 3; and FIG. 5 is a transverse cross-sectional view of the shaped charge detonation amplifier shown in FIG. 4 as taken in the direction of arrows 5—5 thereof.

DESCRIPTION OF THE PREFERRED EMBODIMENT

Broadly, the present invention comprises a shock-producing device which may be referred to as a detonation amplifier that is constructed and employed in a manner which precludes personal injury or accidental damage in the event of inadvertent initiation during handling or storage of a liquid explosive composition. Also, the shock-producing device or detonation amplifier may comprise a system of baffles or chambers which confine or partially confine a portion of the liquid to be detonated and/or to direct or focus the shock and/or detonation waves traveling through the liquid in a manner which permits the shock produced by the shock-producing device to detonate a liquid charge which it could not otherwise detonate. Embodiments of the shock-producing or detonation amplifying devices are shown in FIGS. 1 and 2 and FIGS. 3-5 inclusive respectively.

Referring to FIG. 1, the present invention includes a container 11 which holds a bulk quantity of liquid explosive composition 12 into which a shock-producing or detonation amplifying device 10 is submerged. The device includes means immediately adjacent to a predetermined portion of the bulk liquid explosive composition into which a small pyrotechnic charge 22 is disposed. The charge is activated in a suitable means such as via electrical wires 24 which may be attached to a suitable actuator. As one example of liquid explosive composition 12, a two component explosive ingredient composition could consist of a common industrial solvent such as nitroethane which is mixed or blended with a commercial grade of nitric acid wherein the mixture occurs at the operational or using site. Nitroethane is an industrial solvent that is readily available in abundant supply at a reasonable or low cost. The physical properties of nitroethane are such that it is inherently safer to use than a large quantity of solvents commonly used in commercial coatings. For example, the lower limit of flammability of nitroethane is 3.4% by volume in air as compared with 1.9%, 1.0% and 2.15% for methyl isobutal ketone, xylene and acetone respectively. Similarly, the flash point of nitroethane (TCC) is 87° F. as compared to flash points of 0° F., 24° F. and 81° F. for acetone, methylethyl ketone and xylene respectively.

The other ingredient of the two component composition is a commercial grade nitric acid which is similarly an abundant, readily available, low cost ingredient. The nitric acid found to be useful as a sensitizer for nitroethane is aqueous nitric acid which contains from 60% to 75% nitric acid. The nitric acid ingredient as well as the nitroethane ingredient may be separately transported and shipped with little or no difficulty using ordinary precautions.

In practice, the two component bulk liquid explosive composition 12 is prepared by mixing the proper weight of nitric acid ($HNO_3$) and nitroethane ($CH_3CH_2NO_2$) in a clean container 11 as the explosive composition is needed at the operational or using site. The nitroethane is totally miscible in aqueous nitric acid solution over a wide temperature range as long as the acid content of solution is at least 60%. Nitroethane is immiscible with the nitric acid in concentrations less than 58% acid. Further details concerning the mixture of the two ingredients to form the liquid explosive composition are set forth in copending application for U.S. Letters Patent having Ser. No. 06/778,972 filed on Sept. 23, 1985. The information contained in this copending patent application is incorporated into the present specification as if herein written in full.

Referring now in detail to FIG. 2, the shock-producing or detonation amplifying means 10 comprises a small pyrotechnic charge such as a mild cap 22 which is placed inside a small detonation chamber 16 having the inside surface 21 directly opposing and in fixed space relationship with respect to the charge 22. It is noted that the bottom 18 and top 20 are provided with openings or vents 28 and 26 respectively which permit the liquid explosive composition to flow into the interior of the chamber 16. It is to be noticed that the top lid or wall 20 may be readily removed from the chamber in order to insert or remove the charge 22 when desired. The chamber 16 is submerged into the surrounding bulk liquid composition 12 at which time a portion of the composition flows into the interior of the compartment. The apparatus or means 10 takes the form of a detonation amplifier employing an enclosed chamber 16 which is identified by the numeral 14 as an overall amplifier means.

If desired, additional safety devices such as an electrical or pyrotechnic safe arm device may be employed in place of a conventional cap 22 which is illustrated.

The size and type of pyrotechnic charge 22 and the size of the chamber defined by wall 21 as well as the vent openings or holes 26 and 28 are selected so that in event of accidental ignition, the products of detonation will be sufficiently confined to prevent injuries to personnel handling the device and to prevent ignition of similar nearby devices. Also, the size and type of charge is selected so that when initiated, the pyrotechnic device 22 will reliably cause detonation of the liquid within the confines of the chamber 16 which will subsequently detonate the surrounding bulk liquid explosive composition external of the chamber 16. Detonation of the liquid explosive composition confined within the chamber insures relaiable detonation of the remainder of the bulk liquid explosive composition 12.

Referring now in detail to FIGS. 3, 4 and 5, another embodiment of shock-producing or detonation amplifier means is illustrated in the general direction of arrow 30 consisting of a pyrotechnic cap or charge 36 which, when initiated via igniter line 48, initiates detonation in a length of linear shaped charge 38 which produces a shock wave in the liquid 46 such as the nitromethane and nitric acid composition noted above. The shock wave is reflected against a baffle plate 40 in a manner which causes detonation of that portion of the liquid explosive composition between the linear shaped charge 38 and the baffle plate 40 and, ultimately, detonation of the entire liquid explosive composition 34. Brackets 42 and 44 interconnect the baffle plate 40 with the cap 36 and the charge 38. The overall container is identified by numeral 32 and contains the bulk quantity of liquid explosive composition 34 into which the pyrotechnic detonation amplifier 30 is submerged.

Therefore, it can be seen that the inventive detonation amplifier means taking the form of the chamber version indicated by numeral 10 or the shaped charge version including the baffle shown by numeral 30 provides a means whereby a comparatively safe and insensitive liquid, such as nitromethane, can be used without the employment of additional sensitizers or other chemicals normally required for safe detonation. Also, the inventive concept can be readily inserted into the liquid explosive composition, then removed and drained to return it and the liquid to their like-new condition so as to permit a placed charge to be safely and easily disarmed and either reused at a later time or disposed of as required. By using either the detonation amplifier 10 or 30, a small portion of the bulk explosive composition is detonated which, in turn, subsequently causes the total explosion of the remaining bulk of the composition within the container.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a detonator apparatus for liquid explosive compositions, the combination which comprises:

a container enclosing a bulk quantity of combined explosive liquid ingredients;

a detonation amplifier submerged in said liquid ingredients within the confines of said container;

a portion of said explosive liquid ingredients held in said detonation amplifier;

a pyrotechnic charge immersed in said held portion of liquid ingredients; and activation means operably coupled to said pyrotechnic charge for detonating said pyrotechnic charge causing detonation of said bulk quantity of combined liquid ingredients.

2. The invention as defined in claim 1 wherein:

said detonation amplifier includes an enclosure housing said pyrotechnic charge and provided a plurality of apertures communicating the interior of said enclosure with the surrounding bulk quantity of combined explosive liquid ingredients.

3. The invention as defined in claim 2 wherein:

said portion of liquid ingredients resides immediately about said pyrotechnic charge; and said pyrotechnic charge is a solid charge.

4. The invention as defined in claim 3 wherein:

said activation means is remotely located from said container.

5. The invention as defined in claim 4 including;

means carried on said container for downwardly suspending said detonation amplifier into said surrounding bulk explosive liquid ingredients.

6. The invention as defined in claim 1 wherein:

said pyrotechnic charge is a shaped charge producing a shock wave reflectable from the impacting surface of said container effective to detonate said bulk quantity of explosive liquid ingredients.

7. The invention as defined in claim 6 wherein:

said container is substantially open to flow of said bulk quantity of explosive liquid ingredients and includes a shaped baffle constituting said impacting surface.

8. The invention as defined in claim 7 wherein:

said baffle shaped surface is substantially wedge shaped in cross-section having an apex facing said pyrotechnic charge.

9. In a detonation apparatus for liquid explosive compositions contained in bulk form in a container, the improvement which comprises:

a detonation amplifier immersed into a portion of said bulk composition having a pyrotechnic charge adapted to be remotely ignited so as to detonate a limited portion of said bulk composition.

10. The invention as defined in claim 9 wherein:

a housing for supporting said pyrotechnic charge in said limited portion of said bulk composition.

11. The invention as defined in claim 10 wherein:

said pyrotechnic charge is a shaped charge; and baffle means spaced from said pyrotechnic charge for reflecting a shock wave effective to detonate said limited portion of said bulk composition preparatory to detonation of said bulk composition.

12. A method of detonating liquid explosive compositions in bulk form comprising the steps of:

placing the liquid explosive compositions into a container;

confining a portion of the placed liquid explosive compositions about a pyrotechnic charge;

igniting the confined portion of liquid explosive compositions via the pyrotechnic charge; and detonating the bulk composition by the ignited confined portion of the liquid explosive compositions.

* * * * *